US008910389B1

(12) United States Patent
Kamar et al.

(10) Patent No.: US 8,910,389 B1
(45) Date of Patent: Dec. 16, 2014

(54) DOOR LEVELING APPARATUS AND METHODS OF USE

(71) Applicants: Andrew Joseph Kamar, Torrance, CA (US); Timothy James Grimmond, El Segundo, CA (US)

(72) Inventors: Andrew Joseph Kamar, Torrance, CA (US); Timothy James Grimmond, El Segundo, CA (US)

( * ) Notice: Subject to any disclaimer, the term of this patent is extended or adjusted under 35 U.S.C. 154(b) by 63 days.

(21) Appl. No.: 13/937,062

(22) Filed: Jul. 8, 2013

Related U.S. Application Data

(60) Provisional application No. 61/669,204, filed on Jul. 9, 2012.

(51) Int. Cl.
*E04F 21/00* (2006.01)
*E05B 17/06* (2006.01)

(52) U.S. Cl.
USPC ..... 33/194; 33/197

(58) Field of Classification Search
USPC ..... 33/194, 197
See application file for complete search history.

(56) References Cited

U.S. PATENT DOCUMENTS

| | | | | |
|---|---|---|---|---|
| 5,359,782 | A * | 11/1994 | Langmaid | 33/415 |
| 5,479,804 | A * | 1/1996 | Cook | 33/608 |
| 5,713,135 | A | 2/1998 | Acopulos | |
| 7,310,887 | B2 | 12/2007 | Nash et al. | |
| 7,421,791 | B2 * | 9/2008 | Adkins et al. | 33/197 |
| 7,797,845 | B2 | 9/2010 | Durham | |
| 7,886,450 | B1 * | 2/2011 | Fiano | 33/286 |
| 8,190,389 | B2 * | 5/2012 | Kim et al. | 33/501 |
| 8,209,874 | B1 * | 7/2012 | Tribble et al. | 33/286 |
| 8,832,949 | B2 * | 9/2014 | Allen et al. | 33/194 |
| 2001/0037579 | A1 | 11/2001 | Akers | |
| 2006/0272166 | A1 * | 12/2006 | Adkins et al. | 33/197 |
| 2009/0113733 | A1 | 5/2009 | Hale | |
| 2009/0154775 | A1 | 6/2009 | Lea et al. | |

* cited by examiner

*Primary Examiner* — Yaritza Guadalupe-McCall
(74) *Attorney, Agent, or Firm* — One3 IP Management, P.C.; Justin G. Sanders

(57) ABSTRACT

A door leveling apparatus is configured for assisting in the cutting of a lower edge of a door to match a base angle of a base of a door frame. In the exemplary embodiment, a housing is removably engagable with a hinge of each of the door and door frame and provides a pivotally engaged leveling arm configured for selectively pivoting away from the housing toward the base of the door frame. A laser assembly is pivotally engaged with a distal end of the leveling arm and comprises a laser housing capable of selectively emitting a laser beam and an angle adjustment knob configured for selectively retaining the laser housing at a desired laser angle that matches the base angle. The apparatus may then be removably engaged with the hinge of the door so that the laser beam may project the line on which the door is to be cut.

20 Claims, 7 Drawing Sheets

DOOR LEVELING APPARATUS AND METHODS OF USE

RELATED APPLICATIONS

This application claims priority and is entitled to the filing date of U.S. Provisional Application No. 61/669,204, filed on Jul. 9, 2012 and entitled "Door Leveling Device Tool." The contents of the aforementioned application are incorporated by reference herein.

INCORPORATION BY REFERENCE

Applicants hereby incorporate herein by reference any and all patents and published patent applications cited or referred to in this application.

BACKGROUND OF THE INVENTION

1. Field of the Invention

Aspects of this invention relate generally to carpentry devices, and more particularly to a door leveling apparatus configured for assisting in the cutting of a bottom rail of a door to match the angle of the floor, or threshold, of the frame in which the door is to be hung, so as to create a uniform gap therebetween.

2. Description of Related Art

By way of some background information, when hanging a door in a door frame, it is always recommended that the door frame be plumb and level to ensure that the door itself will be level when hung. However, oftentimes, the door frame is not completely plumb, which may cause the bottom rail, or at least a portion of the bottom rail, of the door to contact the floor or threshold of the frame (hereinafter simply referred to as the "base" of the door frame) when swinging open and closed. Similarly, even if the door frame is completely plumb, the base of the frame may not be completely level, which may also cause some or all of the bottom rail to contact the base. Even if the bottom rail does not physically contact the base of the frame, a non-uniform gap between the two may be deemed aesthetically displeasing to some. Thus, there is a need for an apparatus and associated method for better ensuring that a uniform gap exists between the bottom rail of a door and base of the frame in which the door is hung.

The following art defines the present state of this field:

U.S. Pat. No. 5,713,135 to Acopulos is generally directed to a multi-purpose carpentry measuring device. The tool combines the functions of a framing square, level and plum bob in one function and with just one measurement. Further, the tool can also be used as a bevel gauge and a level bench marker. A foot and leg member, joined by a pivot, contain bubble tubes for all necessary horizontal and vertical level measurements. Extendible rules on both members further increase the usefulness of the device. The tool has a built-in magnetic disc and bar code reader for continuously displaying angular read out on an integral calculator. Laser pin lights at either end of the tool allow for laser precision in all level bench marker observations as may be facilitated by a positioning pin disposed in said device.

U.S. Patent Application Publication No. 2001/0037579 to Akers is generally directed to a leveling assembly to establish elevations in a building structure for installing cabinets, bookshelves, countertops, etc. There is a telescoping mounting post adapted to be positioned in bearing engagement between a floor surface and the top of a doorway, ceiling or other upper surface. A laser that transmits a horizontal laser beam is mounted to a mounting device that can be moved to different positions along the length of the post. Locking devices hold the laser mounting device in place, and also properly position the post to be in firm engagement with its bearing surfaces. The laser mounting device can be swung to upper and lower positions.

U.S. Pat. No. 7,310,887 to Nash et al. is generally directed to a line generating device that generates two fan-shaped beams of light at an angle to each other, and projects the beams onto an adjacent surface, where the beams are visible as lines on the surface. A user has access to the intersection of the lines, so that the intersection can be marked or otherwise used in combination with the lines, such as in aligning objects.

U.S. Patent Application Publication No. 2009/0113733 to Hale is generally directed to an extendable plumb and level measuring device and associated usage method. The device can utilize interconnected members including a first, a second, and a third member. For example, the third member can be slidingly disposed within the first and second members to extend the device to a set and arbitrary length. The measuring device utilizes a spirit level or digital reader to determine when the device itself is level responsive to positioning a extendable stopper against a construction, such as a wall, door, panel, and the like. Once level, a measuring device, such as a ruler, disposed within the device can be utilized to measure the plumb of the construction. Additionally, the device can function as an extendable level to measure an arbitrary length.

U.S. Patent Application Publication No. 2009/0154775 to Lea et al. is generally directed to a method and apparatus used to fit a metallic or composite doubler on an uneven surface. A three dimensional digital map of the gap between the doubler and the uneven surface is generated by digitally scanning the uneven surface. The digital map is then used to fabricate a stack of adhesive plies tailored to substantially fill the gap between the doubler and the uneven surface.

U.S. Pat. No. 7,797,845 to Durham is generally directed to a mobile leveling apparatus for quickly and simply transferring the height of a visible, fixed datum point from a distant wall or column across a room. The leveling apparatus is hand-held and can be operated by a single user. The operator physically holds the apparatus at the actual point where the height of the datum point is required, thereby ensuring that the apparatus is always under his/her control.

The prior art described above teaches various devices configured for measuring the levelness of a structure such as a floor, wall, window or door. However, the known prior art fails to teach an apparatus capable of assisting in the cutting of a bottom rail of a door to match the angle of the floor, or threshold, of the frame in which the door is to be hung, so as to create a uniform gap therebetween. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the problems described above by providing a door leveling apparatus configured for assisting in the cutting of a lower edge of a door to match a base angle of a base of a door frame relative to a vertically oriented hinge jamb of the door frame, along with associated methods of use. The apparatus provides, in the exemplary embodiment, a housing providing an elongate hinge groove along a first side of the housing, the hinge groove sized and configured for removably receiving a barrel portion of a hinge engaged with one of each of the door and door frame. A leveling arm is pivotally engaged proximally with an opposing second side of the housing and configured for selectively moving between one of a stored position, wherein the leveling arm is positioned adjacent to the second side of the housing, and a deployed position, wherein a distal end of the leveling arm is pivoted away from the second side of the housing toward the base of the door frame. A laser assembly is pivotally engaged with the distal end of the leveling arm and comprises a laser housing and an angle adjustment knob. The angle adjustment knob is configured for selectively retaining the laser housing at a desired laser angle relative to the leveling arm. A first end of the laser housing is capable of selectively emitting a continuous, horizontally oriented laser beam a distance above a bottom surface of the laser housing. Thus, in use, with the door temporarily removed from the door frame, the hinge groove removably engaged with the hinge of the door frame, the leveling arm in the deployed position, the bottom surface of the laser housing positioned in abutting contact with the base of the door frame, and the laser angle adjusted to match the base angle, the apparatus is capable of being subsequently removably engaged with the corresponding hinge of the door so that the laser beam may assist in the cutting of the lower edge of the door to match the base angle, thereby creating a uniform gap between the lower edge of the door and the base of the door frame when the door is hung in the door frame.

A primary objective inherent in the above described apparatus and method of use is to provide advantages not taught by the prior art.

Another objective is to provide such an apparatus that is capable of assisting in the cutting of a bottom rail of a door to match the angle of the floor, or threshold, of the frame in which the door is to be hung, so as to create a uniform gap therebetween, in at least one embodiment.

Another objective is to provide such an apparatus that is capable of being utilized in connection with any other type of hinged structure now known or later developed, such as windows, in at least one embodiment.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
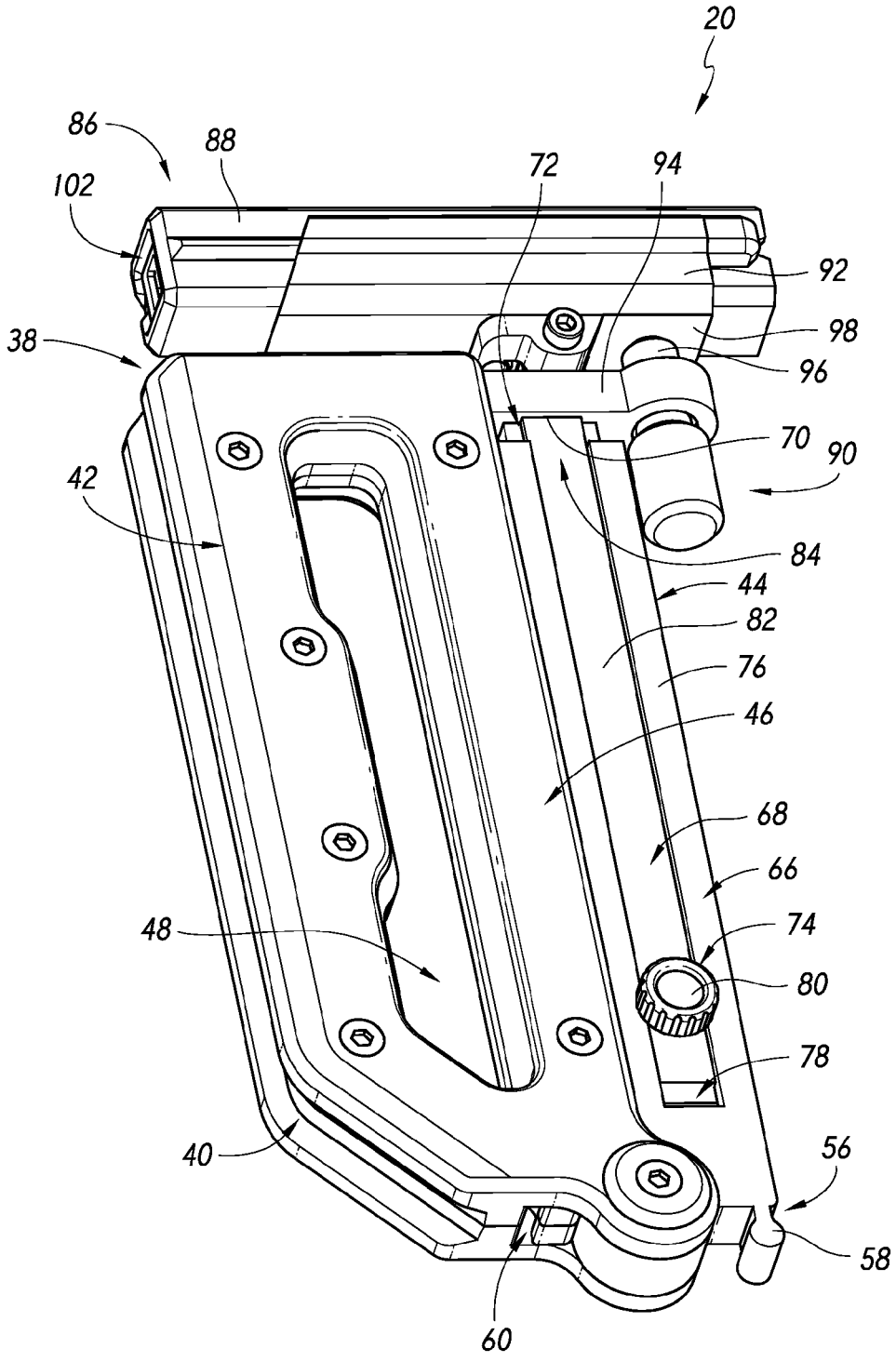
FIG. 1 is a perspective view of an exemplary door leveling apparatus, in accordance with at least one embodiment.

Turning now to FIG. 1, there is shown a perspective view of an exemplary embodiment of a door leveling apparatus 20 configured for assisting in the cutting of a bottom rail 22 of a door 24 to match a base angle 26 of a floor or threshold (hereinafter simply referred to as a "base" 28) of a door frame 30—in which the door 24 is to be hung—relative to a vertically oriented hinge jamb 32 of the door frame 30, so as to create a uniform gap 34 between a lower edge 36 of the bottom rail 22 and the base 28 of the door frame 30. It should be noted that the dimensions of the door frame 30 and door 24 in the associated drawings are simply illustrative, and that the apparatus 20 may be utilized in connection with door frames and doors of any shape and/or size, now known or later conceived. It should also be noted that the apparatus 20, in further embodiments, may be utilized in connection with any other type of hinged structure now known or later developed, such as windows. Thus, while the apparatus 20 is shown and described in the context of doors for illustration purposes, the apparatus 20 and its associated methods of use should not be read as being so limited.

With continued reference to FIG. 1, the apparatus 20 comprises, in at least one embodiment, a housing 38 providing an elongate hinge groove 40 along a first side 42 of the housing 38 and a leveling arm 44 pivotally engaged with an opposing second side 46 of the housing 38. Additionally, in at least one embodiment, the housing 38 provides a hand aperture 48 extending therethrough and configured for assisting a user (not shown) with grasping and carrying the apparatus 20. In the exemplary embodiment, the housing 38 is constructed of a combination of metal and plastic; however, in alternate embodiments, the housing 38 may be constructed of any other appropriate material or combination of materials, now known or later developed, capable of allowing the apparatus 20 to substantially carry out the functionality herein described. Furthermore, in the exemplary embodiment, the housing 38 is sized for being a handheld device; however, in alternate embodiments, the housing 38 and associated components may take on any other dimensions, now known or later conceived, handheld or otherwise, capable of allowing the apparatus 20 to substantially carry out the functionality herein described.

As shown best in FIG. 2, in the exemplary embodiment, the hinge groove 40 is sized and configured for removably, yet securely, receiving a barrel portion 50 of each of a separate frame hinge portion 52 and complementary door hinge portion 54 (hereinafter collectively and individually referred to as a "hinge") therewithin. In alternate embodiments, the hinge groove 40 may be sized and configured for removably receiving any other type of hinge, now known or later developed, that might be used to hang the door 24 in the door frame 30 (or to hang another type of hinged structure, depending on the context in which the apparatus 20 is to be used). In the exemplary embodiment, the hinge groove 40 is sized to approximate an outer diameter of the barrel portion 50 of the hinge 52 or 54. Additionally, in the exemplary embodiment, the hinge groove 40 provides an at least one magnet (not shown) positioned within the hinge groove 40 for creating a secure magnetic engagement between the metal hinge 52 or 54 and the hinge groove 40 when the hinge 52 or 54 is selectively positioned therewithin. In at least one such embodiment, a plurality of magnets are positioned along the length of the hinge groove 40. In a further embodiment, the hinge groove 40 itself is constructed of magnetic materials. In alternate embodiments, rather than magnets, any other means for creating a removable engagement between the hinge 52 or 54 and hinge groove 40, now known or later developed, may be substituted. For example, in one such embodiment, the hinge groove 40 may be sized for creating a friction fit with the hinge 52 or 54 when the hinge 52 or 54 is selectively positioned therewithin. It should also be noted that, in alternate embodiments, the hinge groove 40 may be positioned elsewhere on the housing 38, so long as it is capable of substantially carrying out the functionality herein described.

Figure 2:
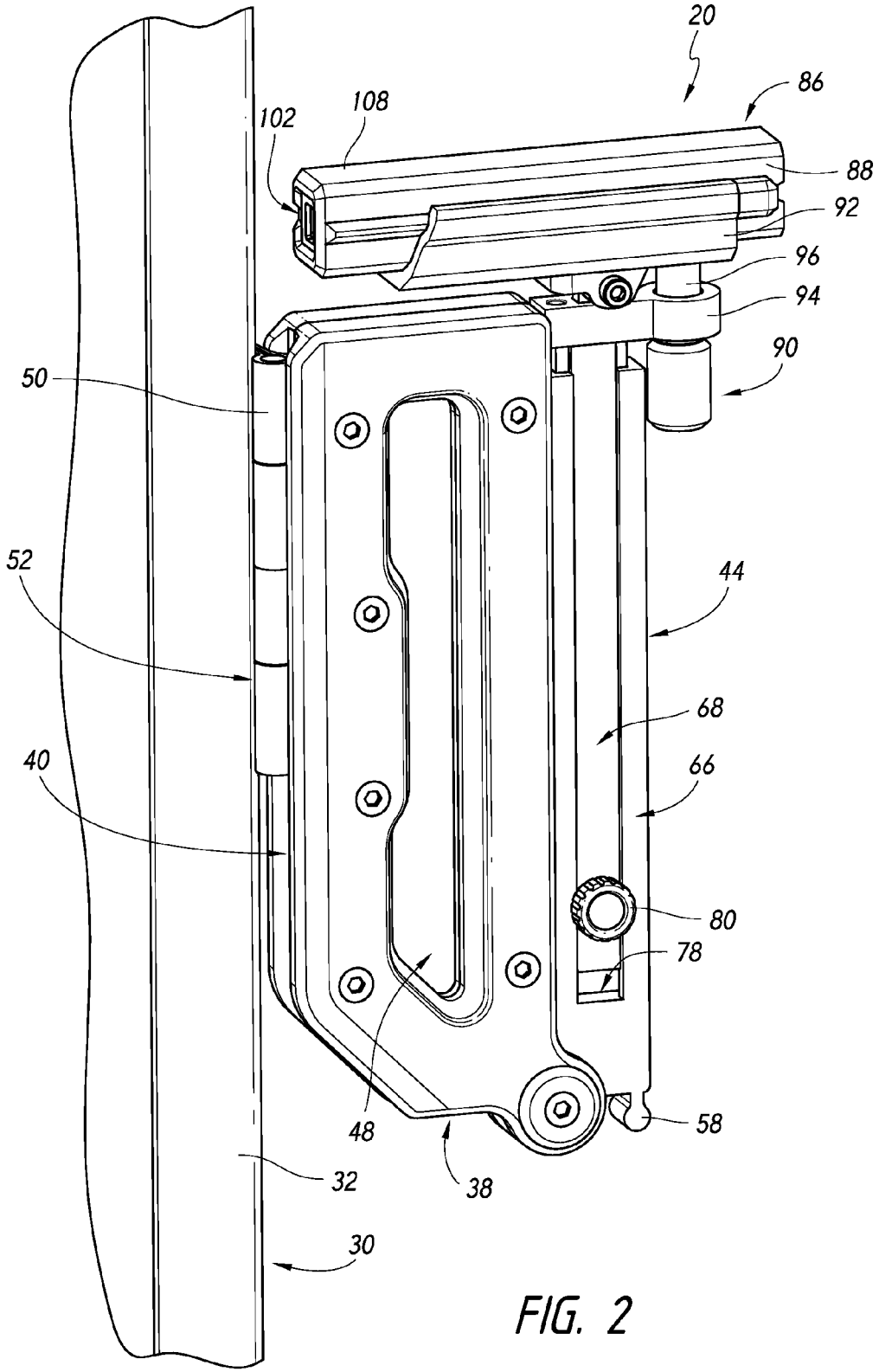
FIGS. 2-4 are perspective views of the exemplary door leveling apparatus as removably attached to an exemplary hinge of a door frame, in accordance with at least one embodiment.
Figure 3:
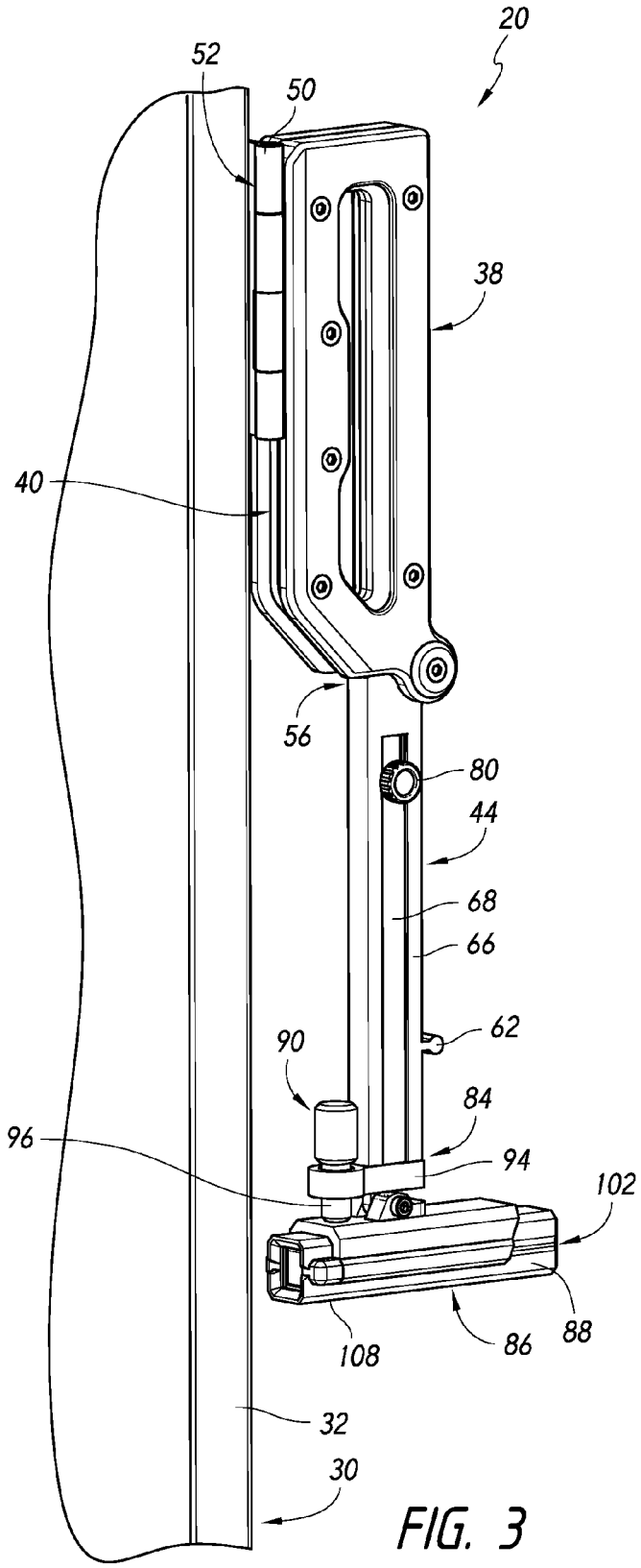

As shown best in FIGS. 2 and 3, in at least one embodiment, the leveling arm 44 is pivotally engaged with the second side 46 of the housing 38 and configured for selectively moving between one of a stored position (FIG. 2), wherein the leveling arm 44 is positioned adjacent to the second side 46 of the housing 38, and a deployed position (FIG. 3), wherein a distal end 84 of the leveling arm 44 is pivoted away from the second side 46 of the housing 38 toward the base 28 of the door frame 30, into a position that is substantially collinear with the housing 38. In other words, in the exemplary embodiment, the leveling arm 44 pivots approximately 180 degrees when moving between the stored and deployed positions. It should be noted that, in alternate embodiments, the leveling arm 44 may be pivotally engaged with other areas of the housing 38, so long as it is capable of substantially carrying out the functionality herein described. Furthermore, in such alternate embodiments, the leveling arm 44 may not be positioned opposite the hinge groove 40 on the housing 38. Thus, the position and arrangement of each of the leveling arm 44 and hinge groove 40 as illustrated in the drawings should not be read as being so limited to that exemplary embodiment.

As shown best in FIG. 1, in at least one embodiment, a proximal end 56 of the leveling arm 44 provides a first tab 58 sized and configured for selectively frictionally engaging a corresponding first aperture 60 provided by the housing 38, when the leveling arm 44 is in the deployed position. Thus, the frictional engagement between the first tab 58 and first aperture 60 assists in preventing the leveling arm 44 from unintentionally moving out of the deployed position. Similarly, as shown best in FIG. 7, in at least one embodiment, the leveling arm 44 provides a second tab 62 sized and configured for selectively frictionally engaging a corresponding second aperture 64 provided by the housing 38, when the leveling arm 44 is in the stored position. Thus, the frictional engagement between the second tab 62 and second aperture 64 assists in preventing the leveling arm 44 from unintentionally moving out of the stored position. It should be noted that, the relative size, shape and position of each of the first and second tabs 58 and 62 and first and second apertures 60 and 64 may vary in alternate embodiments. Additionally, in still further alternate embodiments, any other means, now known or later developed, capable of assisting in preventing the leveling arm 44 from unintentionally moving out of the deployed position and/or stored position, may be substituted.

Figure 4:
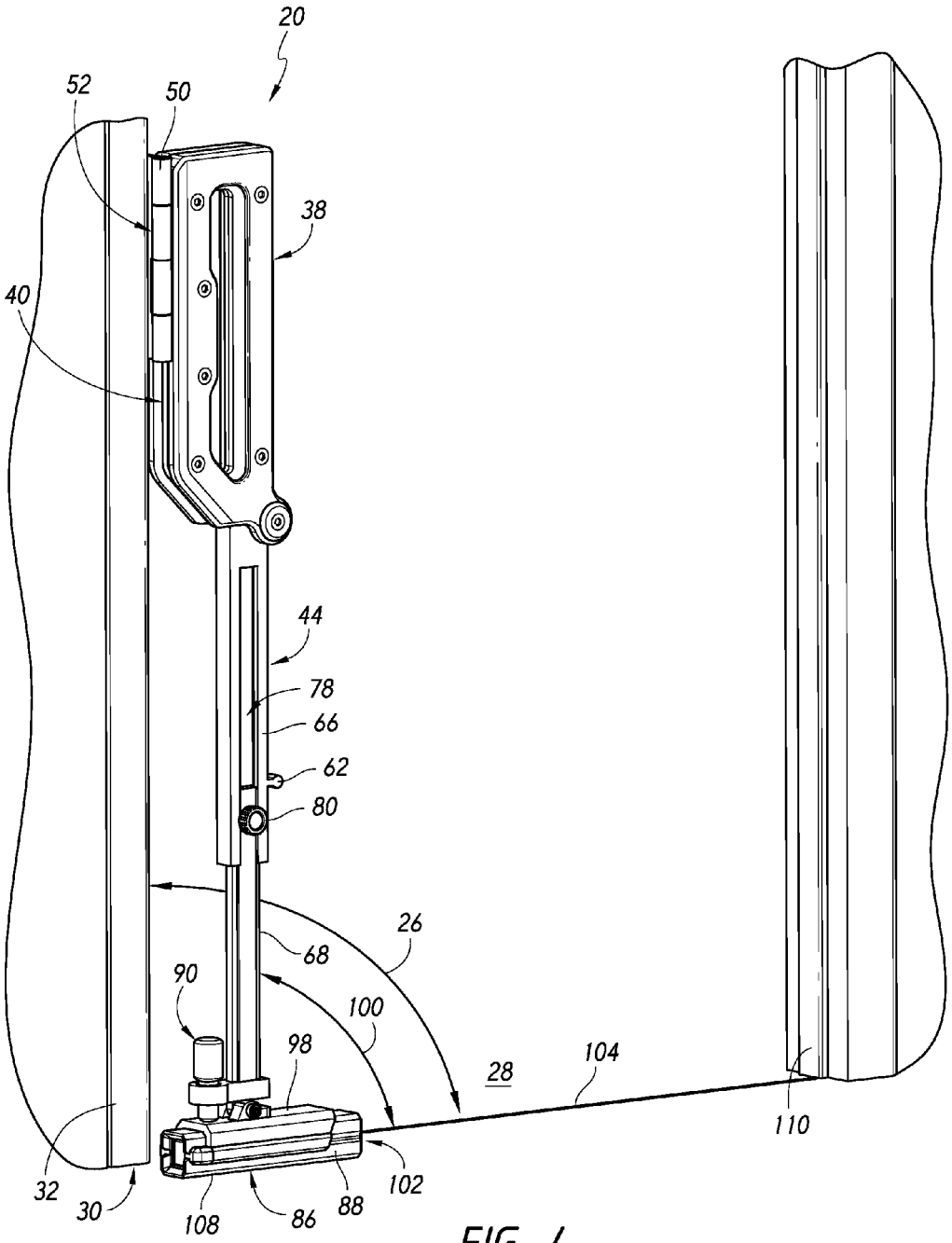

As shown best in FIGS. 3 and 4, in at least one embodiment, the leveling arm 44 is selectively extendable. In a bit more detail, in at least one such embodiment, the leveling arm 44 comprises an elongate guide sleeve 66 and an elongate arm shaft 68 coaxially positioned and slidably engaged within the guide sleeve 66. Thus, the leveling arm 44 is configured for selectively moving between one of an extended position (FIG. 4), wherein a leading edge 70 of the arm shaft 68 extends a distance beyond an open end 72 of the guide sleeve 66, and a retracted position (FIG. 3), wherein the leading edge 70 is positioned relatively closer to the open end 72 of the guide sleeve 66. The leveling arm 44 also preferably provides, in at least one embodiment, a means for preventing the arm shaft 68 from sliding completely out of the guide sleeve 66, such as a physical stop or catch (not shown) positioned proximal the open end 72 of the guide sleeve 66. In the exemplary embodiment, the leveling arm 44 is made of metal; however, in alternate embodiments, the leveling arm 44 may be made of any material or combination of materials now known or later developed, such as a rigid plastic, that allows the leveling arm 44 to substantially carry out the functionality herein described. It should be noted that the relative size, shape and position of each of the guide sleeve 66 and arm shaft 68 may vary in alternate embodiments. Additionally, in still further alternate embodiments, any other structure or means, now known or later developed, capable of allowing the leveling arm 44 to be selectively telescoping or otherwise extendable, may be substituted.

With continued reference to FIGS. 3 and 4, in at least one embodiment, the leveling arm 44 provides an arm lock 74 configured for selectively locking the leveling arm 44 in a desired extended position. In a bit more detail, in one such embodiment, a guide wall 76 of the guide sleeve 66 defines an elongate tightening slot 78 extending a length thereof. Additionally, the arm lock 74 is a tightening knob 80 threadably engaged with a shaft wall 82 of the arm shaft 68 through the tightening slot 78. Thus, as the tightening knob 80 is threadably tightened against the shaft wall 82, the guide wall 76 is sandwiched therebetween, thus frictionally retaining the arm shaft 68 in place within the guide sleeve 66 until the tightening knob 80 is subsequently threadably loosened. It should be noted that, in alternate embodiments, the arm lock 74 may comprise any other structure or means, now known or later developed, capable of selectively locking the leveling arm 44 in a desired extended position.

As shown best in FIGS. 1 and 4, in at least one embodiment, the distal end 84 of the leveling arm 44 provides a laser assembly 86 comprising a laser housing 88 and an angle adjustment knob 90. In a bit more detail, in at least one such embodiment, the laser assembly 86 is pivotally engaged with the leading edge 70 of the arm shaft 68 such that the laser housing 88 is oriented substantially perpendicular to the leveling arm 44. In the exemplary embodiment, the laser assembly 86 further comprises a laser retention clip 92 configured for removably receiving the laser housing 88 therewithin; thus, allowing the laser housing 88 to be selectively removed in order to replace batteries or swap out the laser housing 88 altogether. However, in alternate embodiments, the laser retention clip 92 is omitted and the laser housing 88 is integral with the laser assembly 86.

With continued reference to FIGS. 1 and 4, in at least one embodiment, the angle adjustment knob 90 is threadably engaged with an adjustment arm 94 oriented substantially parallel with the laser housing 88, such that the angle adjustment knob 90 itself is oriented substantially perpendicular to the laser housing 88. Additionally, a threaded end 96 of the angle adjustment knob 90 extends through the adjustment arm 94 and contacts a top surface 98 of the laser housing 88 (or laser retention clip 92, depending on the embodiment). Thus, selectively turning the angle adjustment knob 90 causes a laser angle 100 between the laser housing 88 and leveling arm 44 to change accordingly. In this way, the laser angle 100 is capable of being fine tuned by selectively turning the angle adjustment knob 90 as needed, the importance of which is discussed in detail below. In an alternate embodiment, not shown, the angle adjustment knob 90 is positioned at a point where the laser assembly 86 is pivotally engaged with the leading edge 70 of the arm shaft 68, and is configured for being selectively threadably tightened against the arm shaft 68, with the laser assembly 86 sandwiched therebetween, thereby frictionally retaining the laser assembly 86 (and, thus, the laser housing 88) at the desired laser angle 100 until the angle adjustment knob 90 is subsequently threadably loosened. In other words, in such an alternate embodiment, the angle adjustment knob 90 is configured for functioning in much the same way as the tightening knob 80 of the exemplary embodiment. In still further alternate embodiments, the angle adjustment knob 90 may comprise any other structure or means, now known or later developed, capable of selectively adjusting the laser angle 100.

As illustrated in FIG. 4, a first end 102 of the laser housing 88 is configured for emitting a continuous, horizontally oriented (i.e., perpendicular to the first end 102 of laser housing 88) laser beam 104, similar to that produced by a laser level, when activated. In the exemplary embodiment, the laser beam 104 is emitted from the first end 102 a height 106 of approximately one-eighth of an inch (⅛") above a bottom surface 108 of the laser housing 88, the importance of which is discussed in detail below. However, in alternate embodiments, the height 106 of the laser beam 104 above the bottom surface 108 of the laser housing 88 may be any other distance desired (depending on the context in which the apparatus 20 is to be used).

Figure 5:
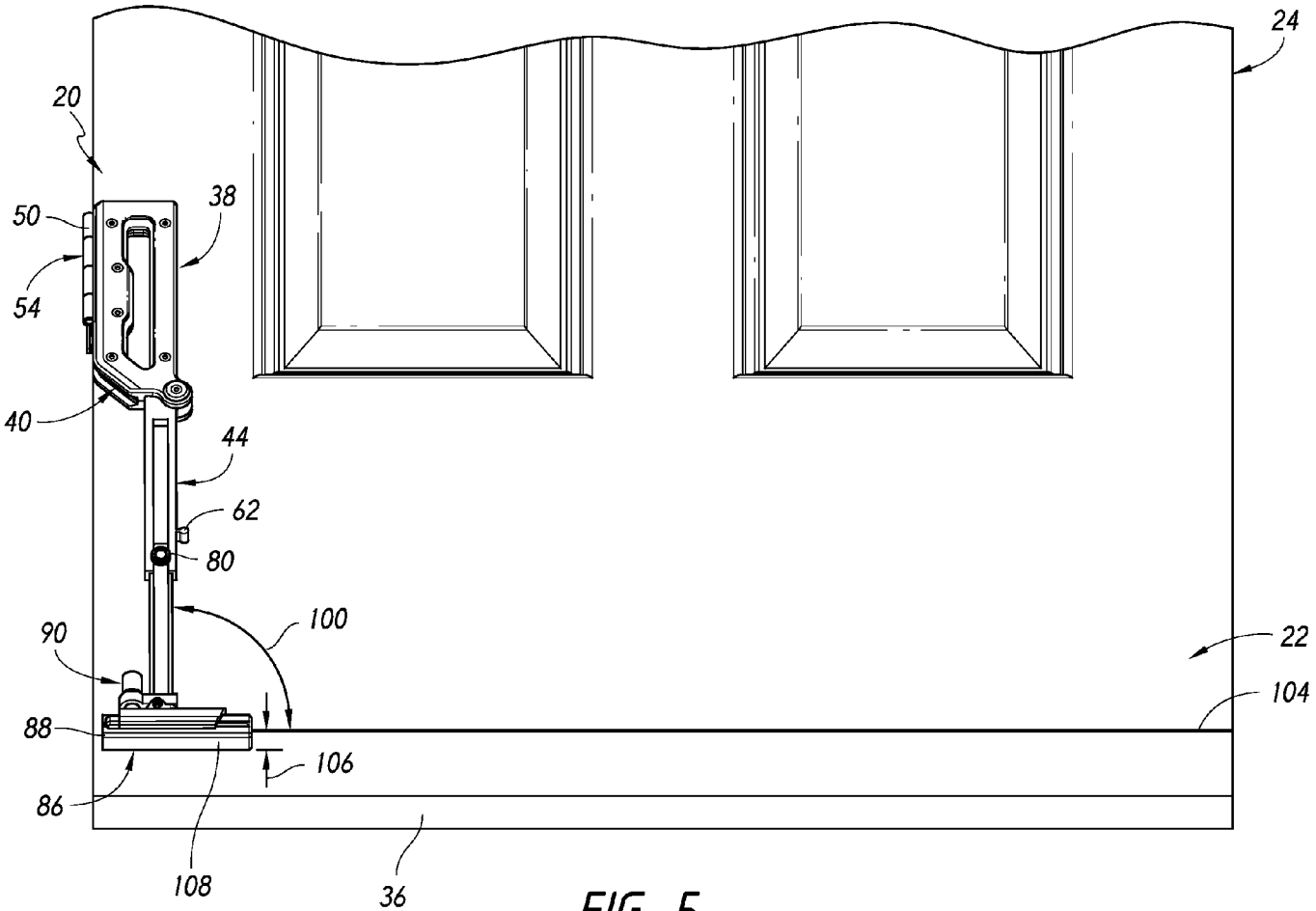
FIG. 5 is a perspective view of the exemplary door leveling apparatus as removably attached to an exemplary hinge of a door, in accordance with at least one embodiment.
Figure 6:
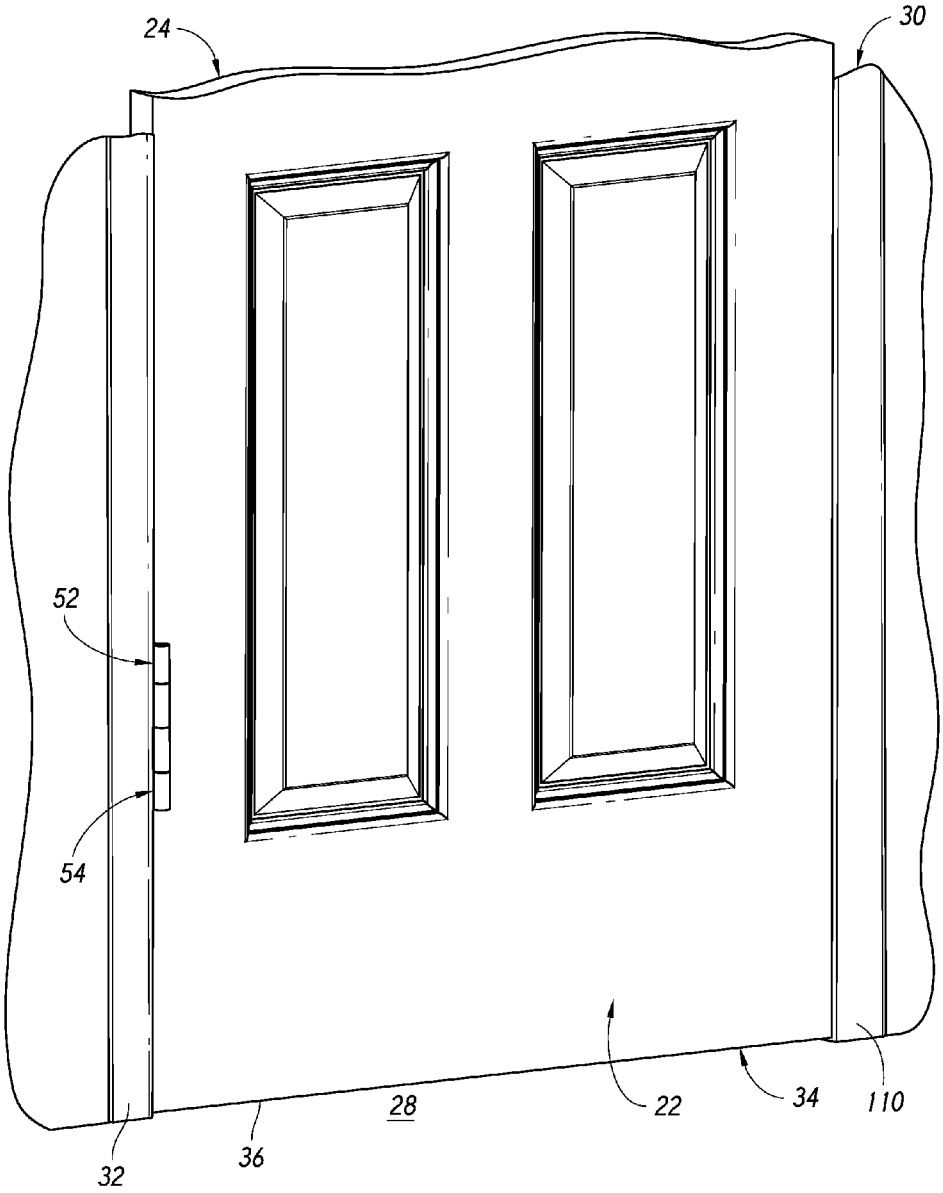
FIG. 6 is a perspective view of an exemplary door hung from an exemplary door frame, in accordance with at least one embodiment.

In use, with the door 24 temporarily removed from the door frame 30, the hinge groove 40 of the apparatus 20 is first removably engaged on one of the frame hinge portions 52 on the door frame 30, as shown in FIG. 2. The leveling arm 44 is then pivoted and locked into the deployed position, as shown in FIG. 3. Next the leveling arm 44 is moved into the extended position such that the bottom surface 108 of the laser housing 88 is in abutting contact with the base 28 of the door frame 30, as shown in FIG. 4. In this way, the laser angle 100 (i.e., the angle between the laser housing 88 and leveling arm 44) is set to match the base angle 26 (i.e., the angle between the base 28 and hinge jamb 32 of the door frame 30). With the laser housing 88 so positioned, the laser beam 104 is activated to ensure that the laser housing 88 is properly oriented such that the laser beam 104 is hitting a vertically oriented lock jamb 110 of the door frame 30 (opposite the hinge jamb 32). The laser beam 104 now defines the imaginary line at which the lower edge 36 of the bottom rail 22 of the door 24 shall be positioned. Furthermore, because the laser angle 100 is identical to the base angle 26, the gap 34 between the laser beam 104 and the base 28 of the door frame 30 is uniform. Each of the tightening knob 80 and angle adjustment knob 90 is then used to rigidly lock each of the arm shaft 68 and laser housing 88 in its respective position. With the respective positions and orientations of the components of the apparatus 20 securely maintained, the apparatus 20 is disengaged from the frame hinge portion 52 on the door frame 30 and the hinge groove 40 is then removably engaged with the corresponding door hinge portion 54 on the door 24, as shown in FIG. 5. The laser beam 104 is then activated once again, which projects onto the bottom rail 22 of the door 24 the line and angle at which the door 24 should be cut, thereby forming the lower edge 36 of the bottom rail 22 of the door 24. The projected laser beam 104 line is scribed onto the door 24, and the apparatus 20 is then disengaged from door hinge portion 54 so that the door 24 may be cut. Once cut, the door 24 is then hung in the door frame 30, now with a uniform gap 34 between the lower edge 36 of the bottom rail 22 and the base 28 of the door frame 30 as shown in FIG. 6.

Given that the laser beam 104 is emitted from the laser housing 88 at a height 106 of approximately one-eighth of an inch (⅛") above the bottom surface 108 of the laser housing 88, the uniform gap 34 between the lower edge 36 of the bottom rail 22 and the base 28 of the door frame 30 has a same height 106 of one-eighth of an inch (⅛"), which has been found to be an acceptable height for allowing the door 24 to open and close freely without contacting the base 28 of the door frame 30. Thus, the position of the laser beam 104 relative to the bottom surface 108 of the laser housing 88 ultimately dictates the height 106 of the uniform gap 34. Again, though, in alternate embodiments, the height 106 of the laser beam 104 above the bottom surface 108 of the laser housing 88—and, thus, the height 106 of the uniform gap 34—may be any other distance desired (depending on the context in which the apparatus 20 is to be used).

Figure 7:
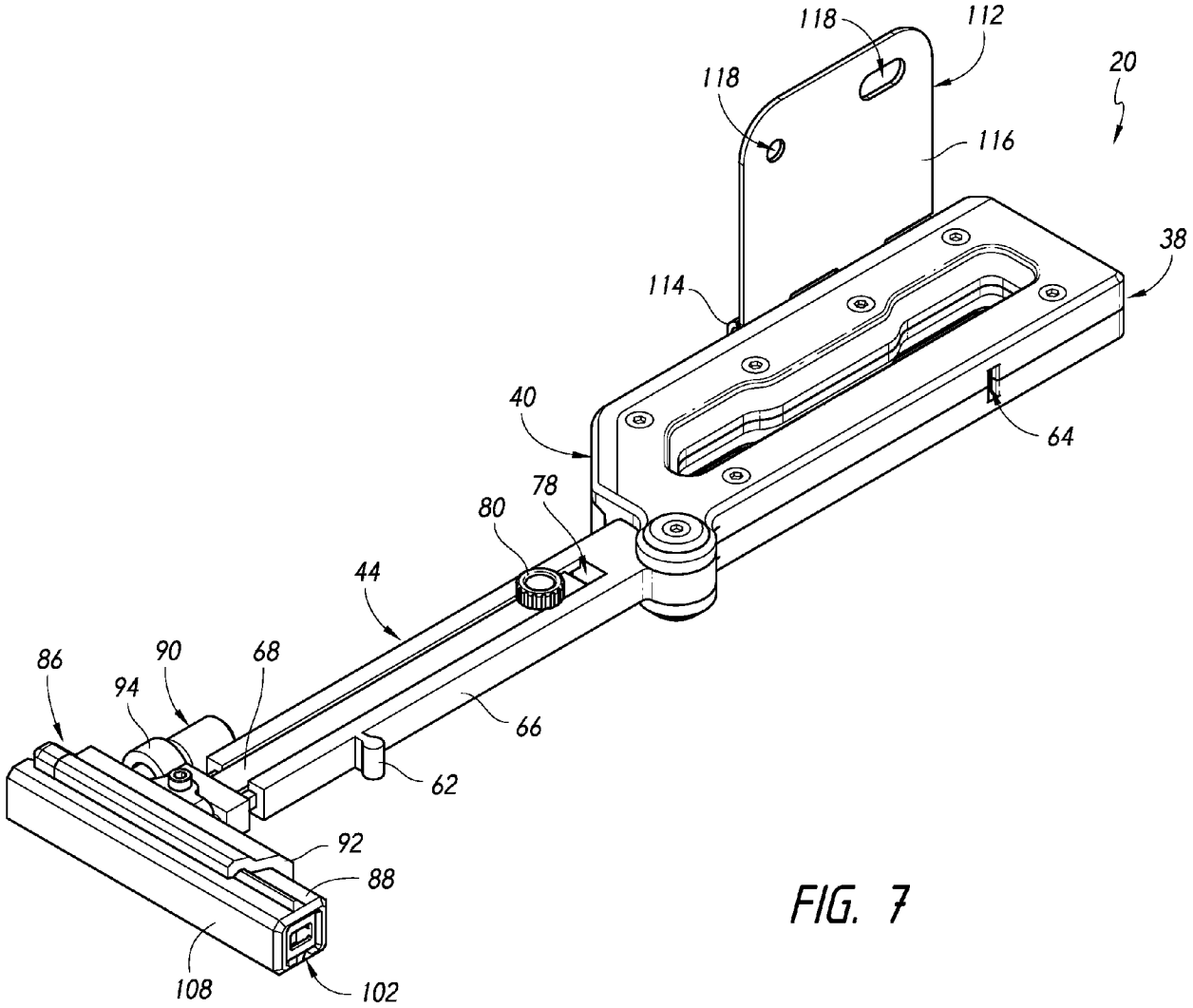
FIG. 7 is a perspective view of the exemplary door leveling apparatus as removably attached to an exemplary false hinge, in accordance with at least one embodiment.

As shown in FIG. 7, during use of the apparatus 20, should either the door frame 30 or the door 24 lack the appropriate hinge 52 or 54 (i.e., if the respective hinge 52 or 54 has not yet been installed), the apparatus 20 may nevertheless be utilized by using an optional false hinge 112. In other words, the false hinge 112 is configured for being temporarily installed in the appropriate position on the door frame 30 or door 24 as needed, in place of the actual hinge 52 or 54, so that the hinge groove 40 of the apparatus 20 may be removably engaged therewith for carrying out the above described functionality, prior to the actual hinge 52 or 54 being installed. In at least one such embodiment then, the false hinge 112 comprises the same structure and dimensions as the respective hinge 52 or 54 it is intended to temporarily replace. In a bit more detail, the false hinge 112 comprises a false barrel portion 114 sized and configured for being selectively positioned within and removably engagable with the hinge groove 40, along with an integral false mounting plate 116. The false mounting plate 116 provides a plurality of mounting holes 118 sized and arranged for selectively mounting the false hinge 112 to either the door frame 30 or door 24 as needed. Once use of the apparatus 20 has concluded, the false hinge 112 may be removed and replaced with the actual hinge 52 or 54.

In at least one embodiment (not shown), the housing 38 of the apparatus 20 provides guide markings configured for assisting in properly aligning the appropriate hinge 52 or 54 within the hinge groove 40, thereby better ensuring that the hinge groove 40 is removably engaged at the same point with each of the frame hinge portion 52 and door hinge portion 54 so as to accurately transfer the height and angle of the necessary cut obtained by the apparatus 20 from the door frame 30 to the door 24.

In at least one embodiment (not shown), the housing 38 provides an at least one bubble tube positioned and configured for visually representing the plumbness of the hinge jamb 32 of the door frame 30. Similarly, in at least one embodiment (also not shown), the laser assembly 86 provides at least one bubble tube positioned and configured for visually representing the levelness of the base 28 of the door frame 30 between the hinge and lock jambs 32 and 110.

To summarize, regarding the exemplary embodiments of the present invention as shown and described herein, it will be appreciated that a door leveling apparatus, and associated methods of use, is disclosed and configured for assisting in the cutting of a bottom rail of a door to match the angle of the floor, or threshold, of the frame in which the door is to be hung, so as to create a uniform gap therebetween. Because the principles of the invention may be practiced in a number of configurations beyond those shown and described, it is to be understood that the invention is not in any way limited by the exemplary embodiments, but is generally directed to a door leveling apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A door leveling apparatus configured for assisting in the cutting of a lower edge of a door to match a base angle of a base of a door frame relative to a vertically oriented hinge jamb of the door frame, the apparatus comprising:

a housing providing an elongate hinge groove along a first side of the housing, the hinge groove sized and configured for removably receiving a barrel portion of a hinge of each of the door and door frame;

a leveling arm pivotally engaged proximally with an opposing second side of the housing and configured for selectively moving between one of a stored position, wherein the leveling arm is positioned adjacent to the second side of the housing, and a deployed position, wherein a distal end of the leveling arm is pivoted away from the second side of the housing toward the base of the door frame;

a laser assembly pivotally engaged with the distal end of the leveling arm and comprising a laser housing and an angle adjustment knob, the angle adjustment knob configured for selectively retaining the laser housing at a desired laser angle relative to the leveling arm; and a first end of the laser housing capable of selectively emitting a continuous, horizontally oriented laser beam a distance above a bottom surface of the laser housing;

whereby, in use, with the door temporarily removed from the door frame, the hinge groove removably engaged with the hinge of the door frame, the leveling arm in the deployed position, the bottom surface of the laser housing positioned in abutting contact with the base of the door frame, and the laser angle adjusted to match the base angle, the apparatus is capable of being subsequently removably engaged with the corresponding hinge of the door so that the laser beam may assist in the cutting of the lower edge of the door to match the base angle, thereby creating a uniform gap between the lower edge of the door and the base of the door frame when the door is hung in the door frame.

2. The door leveling apparatus of claim 1, wherein the housing provides a hand aperture extending therethrough and configured for assisting a user with grasping and carrying the apparatus.

3. The door leveling apparatus of claim 1, wherein the hinge groove provides an at least one magnet positioned within the hinge groove for creating a secure magnetic engagement between the hinge and the hinge groove when the hinge is selectively positioned therewithin.

4. The door leveling apparatus of claim 1, wherein the hinge groove is constructed of magnetic materials for creating a secure magnetic engagement between the hinge and the hinge groove when the hinge is selectively positioned therewithin.

5. The door leveling apparatus of claim 1, wherein the leveling arm pivots 180 degrees when moving between the stored and deployed positions.

6. The door leveling apparatus of claim 1, wherein a proximal end of the leveling arm provides a first tab sized and configured for selectively frictionally engaging a corresponding first aperture provided by the housing when the leveling arm is in the deployed position, thereby assisting in preventing the leveling arm from unintentionally moving out of the deployed position.

7. The door leveling apparatus of claim 6, wherein the leveling arm provides a second tab sized and configured for selectively frictionally engaging a corresponding second aperture provided by the housing when the leveling arm is in the stored position, thereby assisting in preventing the leveling arm from unintentionally moving out of the stored position.

8. The door leveling apparatus of claim 6, wherein the leveling arm is selectively extendable.

9. The door leveling apparatus of claim 8, wherein the leveling arm comprises an elongate guide sleeve and an elongate arm shaft coaxially positioned and slidably engaged within the guide sleeve, the leveling arm configured for selectively moving between one of an extended position, wherein a leading edge of the arm shaft extends a distance beyond an open end of the guide sleeve, and a retracted position, wherein the leading edge is positioned relatively closer to the open end of the guide sleeve.

10. The door leveling apparatus of claim 9, wherein the leveling apparatus provides a means for preventing the arm shaft from sliding completely out of the guide sleeve.

11. The door leveling apparatus of claim 9, wherein the leveling arm provides an arm lock configured for selectively locking the leveling arm in a desired extended position.

12. The door leveling apparatus of claim 11, wherein the arm lock is a tightening knob threadably engaged with a shaft wall of the arm shaft through an elongate tightening slot disposed along a guide wall of the guide sleeve, the tightening knob configured for selectively sandwiching the guide wall and frictionally retaining the arm shaft in place within the guide sleeve.

13. The door leveling apparatus of claim 1, wherein the laser assembly is pivotally engaged with a leading edge of an elongate arm shaft of the leveling arm such that the laser housing is oriented substantially perpendicular to the leveling arm.

14. The door leveling apparatus of claim 1, wherein the laser housing is removably engagable with the laser assembly, the laser assembly providing a laser retention clip configured for removably receiving the laser housing therewithin.

15. The door leveling apparatus of claim 1, wherein the angle adjustment knob is threadably engaged with an adjustment arm oriented substantially parallel with the laser housing, such that the angle adjustment knob itself is oriented substantially perpendicular to the laser housing, a threaded end of the angle adjustment knob extending through the adjustment arm and contacting a top surface of the laser housing for selectively adjusting a laser angle between the laser housing and leveling arm.

16. The door leveling apparatus of claim 1, wherein the angle adjustment knob is positioned at a point where the laser assembly is pivotally engaged with the leveling arm, and is configured for being selectively threadably tightened against the leveling arm, thereby frictionally retaining the laser assembly at a desired laser angle between the laser housing and leveling arm.

17. The door leveling apparatus of claim 1, wherein the laser beam is emitted a distance of roughly one-eighth of an inch (⅛") above the bottom surface of the laser housing.

18. A door leveling apparatus configured for assisting in the cutting of a lower edge of a door to match a base angle of a base of a door frame relative to a vertically oriented hinge jamb of the door frame, the apparatus comprising:

a housing providing an elongate hinge groove along a first side of the housing, the hinge groove sized and configured for removably receiving a barrel portion of a hinge of each of the door and door frame;

a selectively extendable leveling arm engaged proximally with an opposing second side of the housing and configured for selectively moving between one of an extended position, wherein a distal end of the leveling arm extends a distance away from the housing toward the base of the door frame, and a retracted position, wherein the distal end of the leveling arm is positioned relatively closer to the housing;

a laser assembly pivotally engaged with the distal end of the leveling arm and comprising a laser housing and an angle adjustment knob, the angle adjustment knob configured for selectively retaining the laser housing at a desired laser angle relative to the leveling arm; and a first end of the laser housing capable of selectively emitting a continuous, horizontally oriented laser beam a distance above a bottom surface of the laser housing;

whereby, in use, with the door temporarily removed from the door frame, the hinge groove removably engaged with the hinge of the door frame, the leveling arm in the extended position, the bottom surface of the laser housing positioned in abutting contact with the base of the door frame, and the laser angle adjusted to match the base angle, the apparatus is capable of being subsequently removably engaged with the corresponding hinge of the door so that the laser beam may assist in the cutting of the lower edge of the door to match the base angle, thereby creating a uniform gap between the lower edge of the door and the base of the door frame when the door is hung in the door frame.

19. The door leveling apparatus of claim 18, wherein the leveling arm is pivotally engaged with the second side of the housing and configured for selectively moving between one of a stored position, wherein the leveling arm is positioned adjacent to the second side of the housing, and a deployed position, wherein the distal end of the leveling arm is pivoted away from the second side of the housing toward the base of the door frame.

20. A method for cutting a lower edge of a door to match a base angle of a base of a door frame relative to a vertically oriented hinge jamb of the door frame, the method comprising the steps of:

with the door temporarily removed from the door frame, removably engaging a hinge groove of a door leveling apparatus with a hinge of the door frame;

moving a selectively extendable leveling arm, pivotally engaged proximally with the apparatus, into a deployed position wherein a distal end of the leveling arm is pivoted away from the apparatus toward the base of the door frame;

moving the leveling arm into an extended position such that a bottom surface of a laser housing, pivotally engaged with the distal end of the leveling arm, is in abutting contact with the base of the door frame, a first end of the laser housing capable of selectively emitting a continuous, horizontally oriented laser beam a distance above the bottom surface of the laser housing;

aiming the laser beam at a vertically oriented lock jamb of the door frame, opposite the hinge jamb;

setting the laser housing to a laser angle relative to the leveling arm that matches the base angle;

disengaging the hinge groove from the hinge of the door frame;

removably engaging the hinge groove with a corresponding hinge of the door;

activating the laser beam to project onto the door along the set laser angle a cutting line at which the door is to be cut;

cutting the door along the cutting line, thereby forming the lower edge of the door; and hanging the door in the door frame, now with a uniform gap between the lower edge of the door and the base of the door frame.

* * * * *